United States Patent [19]

Higgins

[11] 4,411,474

[45] Oct. 25, 1983

[54] SOLUTION MINING OF AN INCLINED STRUCTURE

[75] Inventor: Rudolph S. Higgins, Moab, Utah

[73] Assignee: Texasgulf Inc., Stamford, Conn.

[21] Appl. No.: 265,665

[22] Filed: May 20, 1981

[51] Int. Cl.[3] ..... E21B 42/28

[52] U.S. Cl. ..... 299/4

[58] Field of Search ..... 299/4, 5

[56] References Cited

U.S. PATENT DOCUMENTS

| | | | |
|---|---|---|---|
| 2,682,396 | 6/1954 | Haworth | 299/5 X |
| 2,822,158 | 2/1958 | Brinton | 299/5 X |
| 3,341,252 | 9/1967 | Dahms et al. | 299/4 |
| 4,239,287 | 12/1980 | Goldsmith | 299/5 X |
| 4,290,650 | 9/1981 | Thompson | 299/4 |

*Primary Examiner*—Ernest R. Purser

*Attorney, Agent, or Firm*—Denis A. Polyn

[57] ABSTRACT

Solution mining method particularly adapted for recovery of potash and the like from relatively thin, inclined strata at substantial depths and involving the dissolution of ore strata, overlain by insoluble strata, while leaving the remainder of the formation in place. Water is injected down a bore hole at a predetermined rate and, being much less dense than present brine, flows in an updip direction along the top of the cavity to a forward mining face remote from the drill hole. Loaded, heavy brine flows downdip along the bottom of the stratum to an outflow pipe communicating with the bottom of the bore hole.

6 Claims, 3 Drawing Figures

SOLUTION MINING OF AN INCLINED STRUCTURE

BACKGROUND OF THE INVENTION

Heretofore it has been generally conceded by those skilled in the art of solution mining of sylvinite deposits that only thick beds, in essentially flat deposits, could be solution mined economically. In prior solution mining, an oil blanket, air blanket or some other such material had to be maintained on the top of the solution mining liquid in the ore cavity in order to avoid dissolution of the salt (NaCl) layer above the ore being mined.

In prior solution mining techniques, the width of the cavity developed by one or a plurality of wells was limited by the stability of the cavity roof and the fact that as the active dissolution face moved farther from the inlet, the major portion of the unsaturated solution was farther removed from contact with the active dissolution area, and solution activity in relation to cavity size decreased.

Exemplary of the prior art technology is the method described in U.S. Pat. No. 3,341,252 (Dahms et al.) entitled "Solution Mining of Sloping Strata". In this patent the method involves drilling a plurality of bore holes spaced in both the directions of the dip and in the direction of the strike in a sloping stratum, and communication is developed among the bore holes in the direction of the strike, but intentionally avoided in the direction of the dip. The patented technique recognizes prior art knowledge that otherwise inert protective layers of nonsolvent material such as hydrocarbon oil would be required to prevent vertical extraction in the cavity.

In U.S. Pat. No. 3,442,553 (Kutz) entitled "Slurry Mining of Carnallite", a method is described for slurry mining of double salts with specific reference to carnallite, which contains potassium chloride and magnesium chloride. In order for the method to work, it is necessary to have a steeply sloping bed containing double salts which form incongruently saturated solutions. The less soluble salt (potassium chloride) is left as a slurry in the bottom of the cavity. The less soluble salt is then removed as a slurry entrained by a saturated or nearly saturated solution of the more soluble salt.

SUMMARY OF THE INVENTION

The present invention provides a method for solution mining of a relatively thin extractable ore stratum in the direction upwardly of a moderately or steeply inclined structure. It is not necessary with this method to maintain an inert nonsolvent protective layer at the top of the cavity since the overlying stratum is composed of nonsoluble material. The method also allows dissolution of beds containing single salts or multiple salts. It comprises establishing a bore hole communicating with the ore stratum and injecting water into the bore hole such that the dissolution of the active mining face moves upwardly just under the insoluble stratum in the updip direction and away from the bore hole. The incoming water flows in the updip direction along the top of the cavity to insure that the fresh water is rapidly and continuously delivered to the active mining face in the cavity.

Solution mining method particularly adapted for recovery of potash and the like from relatively thin, inclined strata at substantial depths and involving the dissolution of ore strata, overlain by insoluble strata, while leaving the remainder of the formation in place.

Water is injected down a bore hole at a predetermined rate and, being much less dense than present brine, flows in an updip direction along the top of the cavity to a forward mining face remote from the drill hole. Loaded, heavy brine flows downdip along the bottom of the stratum to an outflow pipe communicating with the bottom of the bore hole.

DESCRIPTION OF THE PREFERRED EMBODIMENT

Figure 1:
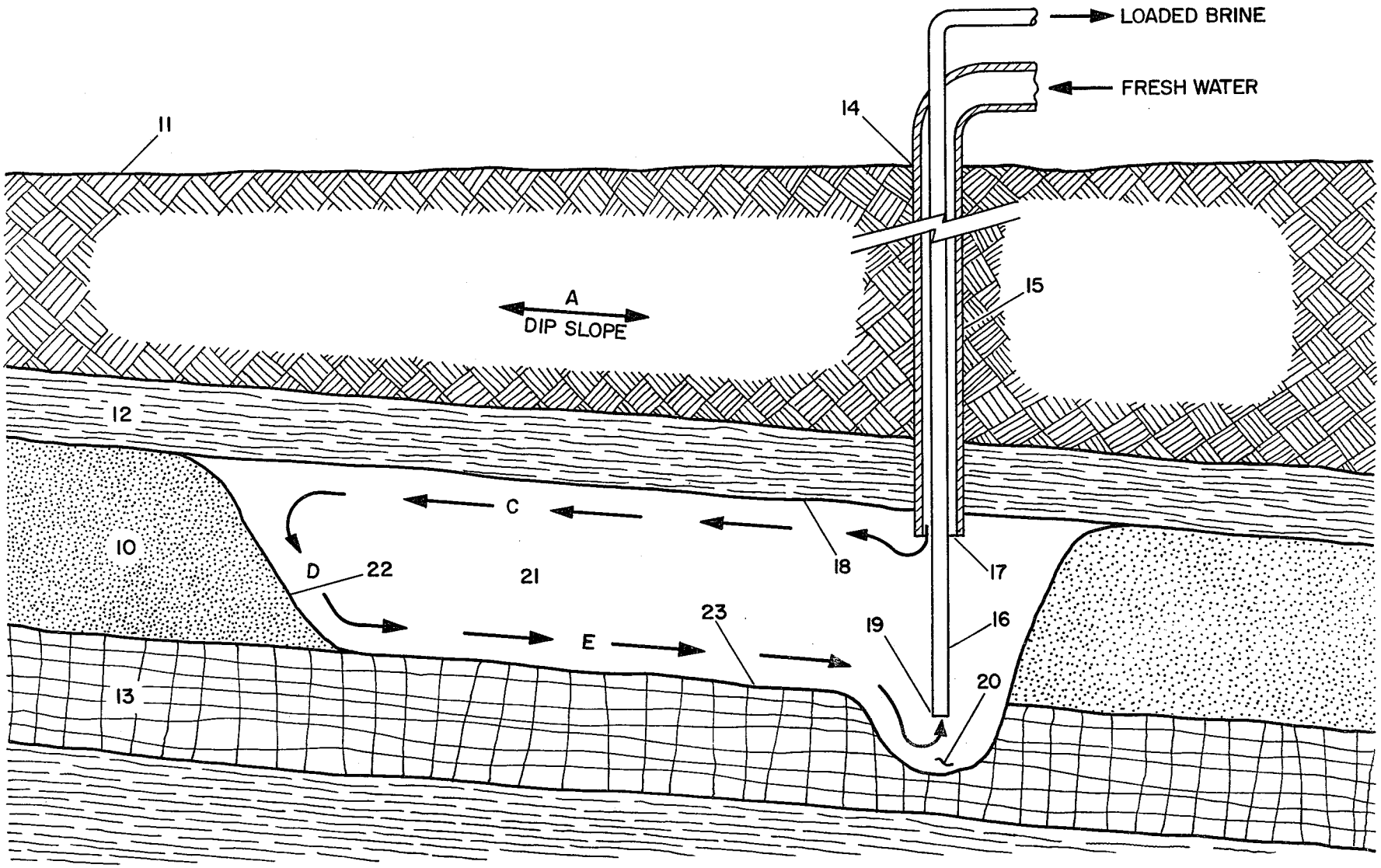
FIG. 1 is a schematic diagram in profile of a cavity being mixed in accordance with the methods of the present invention.

Referring to the drawings, a typical inclined ore formation is shown as to which the method of the present invention is particularly adapted. The formation shown is exemplary of the saline deposits of the Paradox Basin in southeast Utah. Although the rich deposits of potash (KCl) in that area have been known for many years, no economical way of exploiting them had been developed heretofore. One mine based on the conventional room-pillar method of mining was operated for some time but was discontinued due to excessive mining costs. Prior to the present invention, little thought had been given to solution mining in the Paradox Basin area due to the inclined and distorted nature of the deposits. The present invention, as will be described more fully below, takes advantage of this inclined orientation and insoluble zoning to develop an effective and efficient mining system, even in spite of the fact that some of the mineralization of interest is below 7,000 feet.

As indicated in the drawings, the primary salt of interest in sylvinite (KCl.NaCl). The method is, however, applicable to any soluble material bounded by an overlying insoluble zone.

In the formation shown in the drawings, the extractable ore layer 10 is located at a substantial depth below ground level 11 and slopes upwardly in the dip direction, i.e. from right to left as viewed in the drawings, and as indicated by Arrow A. The strike direction, i.e. at a right angle to the dip direction, is indicated by Arrow B.

Immediately above the ore zone or layer 10 is an impermeable and insoluble layer 12 of shale, dolomite, anhydrite or the like, and immediately below the ore lay 10 is a salt layer 13 (NaCl). The layer of salt 13 below the ore layer is not critical to the patented process.

Drill hole 14 extends vertically downward from ground level and initially through ore layer 10 and partially into the underlying salt layer to form a sump 20 for the effluent, as will be described hereinafter. Fresh water pipe 15 extends down bore hole 14 and terminates at its lower end 17 near the upper portion or top 18 of ore layer 10. Exit pipe 16 is concentrically disposed within inlet water pipe 15 and extends downwardly to a terminal point 19 adjacent the sump 20 in salt layer 13.

Figure 2:
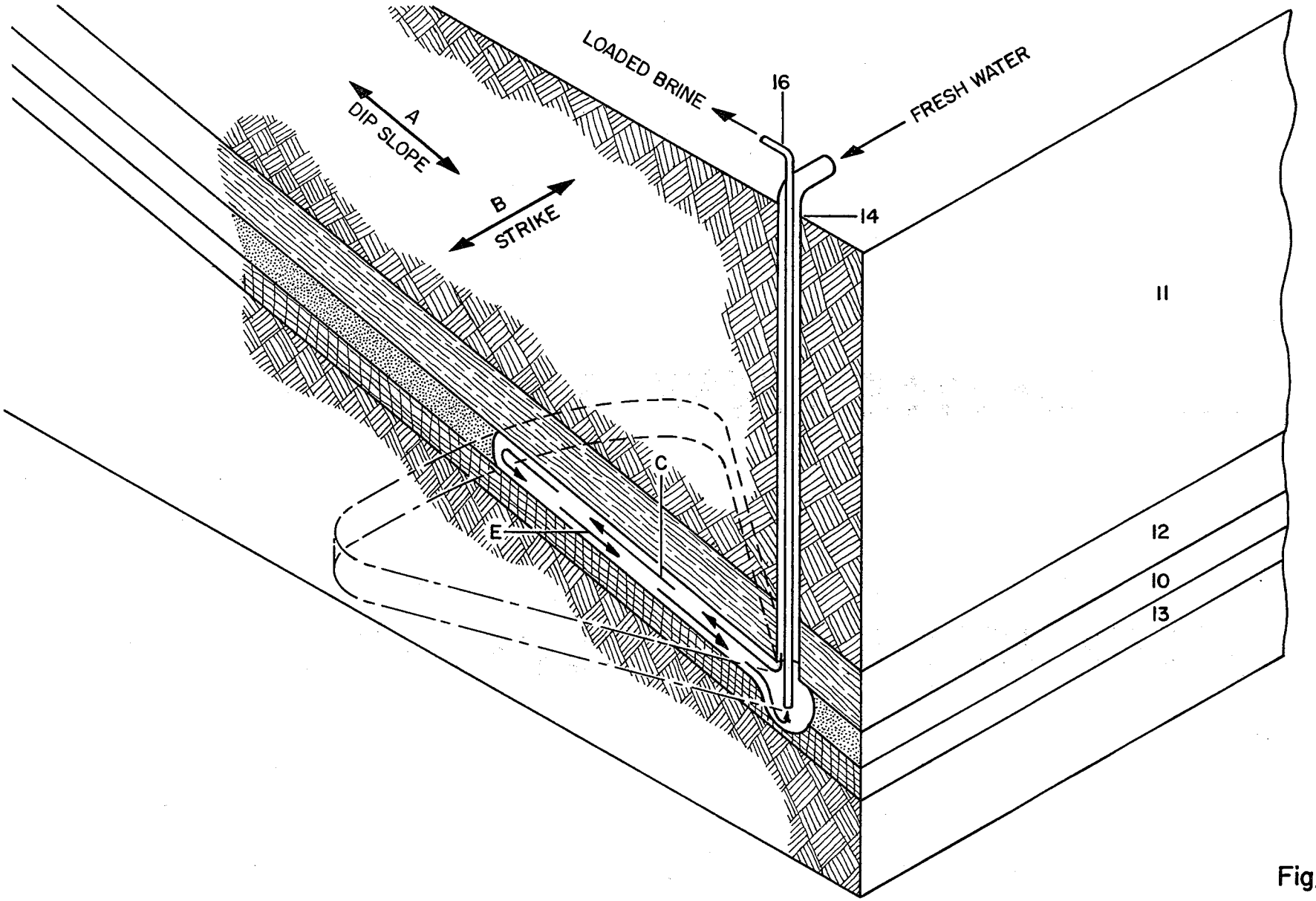
FIG. 2 is an isometric schematic diagram consistent with FIG. 1.

In operation fresh water is injected into the mining cavity 21 through pipe 15 and is discharged and flows along the top 18 of the cavity 21 in the direction of Arrow C, i.e. upwardly in the updip direction, into contact with and outwardly and downwardly along the active mining face 22 as indicated by Arrow D and as shown in FIG. 2. In practice, the solution mining system can operate with water injection down the tubing 16 and brine extraction up the annulus. As shown, the dissolution area or mining face 22 may form a widening arc updip from the drill hole 14. The loaded brine flows downdip along the top 23 of the underlying salt layer 13 in the direction of arrows, into sump 20 and then exits through discharge pipe 16 for further extractive processing by conventional methods such as solar evaporation, standard evaporative crystallizers, etc.

Figure 3:
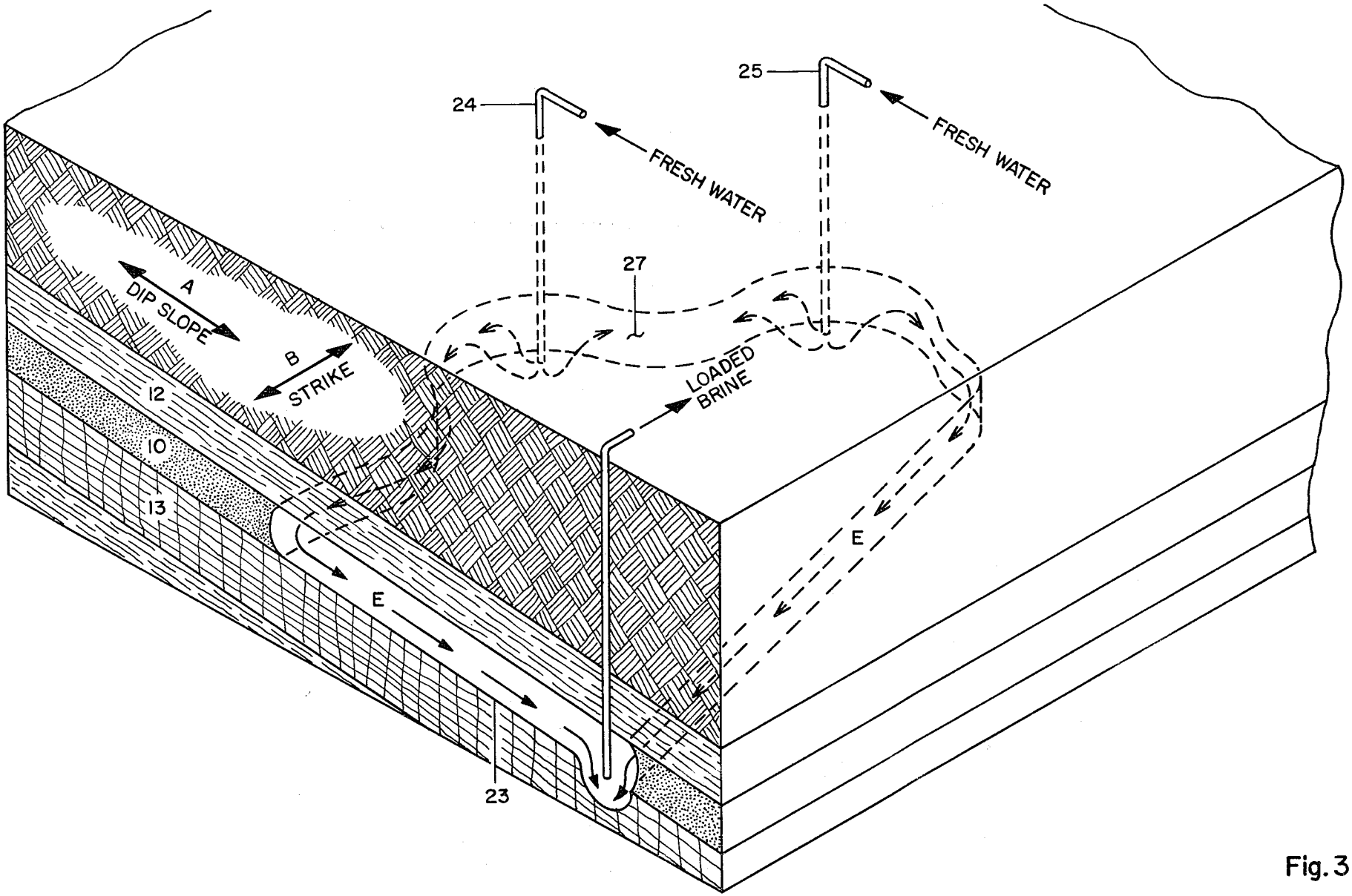
FIG. 3 is an isometric schematic diagram consistent with FIG. 1 showing the extension of the system to a multi-well operation.

FIG. 3 shows the layout as the solution mining process is expanded. This shows injection wells 24 and 25. By moving the injection of fresh water closer to the mining face, the mixing action of the water with the brine is reduced, thereby delivering almost pure water to the dissolution area. This increases the rate of solution, spreads the dissolution area laterally, and increases the ore-water contact area by forming a scalloped-shaped interface 27. When the cavity expanse becomes too large for roof stability, the pressure in the cavity can be increased to provide adequate support.

Although not shown in drawings, any number of initial wells can be developed along the base or side of an inclined structure. The number depends on the mining plan and economic factors.

Extraction under normal operating conditions will be from wells with sumps that are in the lowest part of the solution mining complex, as the brines with the highest densities will migrate to these areas.

The thickness and composition of the stratum extracted controls or determines the injection and extraction rate of the solute. If the rate is too rapid, too much salt from the floor 23 will be dissolved. If the rate is too slow, a thin stratum just under the insoluble layer 12 will be dissolved, and important mineral values will be left on the floor.

Normally the method of the invention will operate at ambient or formation temperature, although heat may be added if desired.

The KCl content of sylvinite mineral zones mined will usually be above about 15% KCl, although there is no upper or lower limit of enrichment that may be mined with the present process.

While one embodiment of the present invention has been shown and described herein, it is to be understood that certain changes and/or additions may be made thereto by those skilled in the art without departing from the scope and spirit of the invention.

I claim:

1. A method of solution mining an extractable ore disposed in a sloping subterranean stratum disposed beneath an insoluble stratum comprising the steps of establishing a bore hole communicating with said stratum at a downdip location therein, injecting solvent into said bore hole in such a manner that the solvent will be directed in an updip direction along the upper portion of said stratum to develop a cavity with an expanding mining face remote from said bore hole, and withdrawing solvent with dissolved ore through said bore hole at an exit point disposed vertically from the entrance point at which the incoming water is discharged into the cavity from the bore hole, adjusting such withdrawal to provide for downflow of the water across said mining face and downwardly in a downdip direction along the floor of said cavity to said exit point at a rate sufficient to extract said ore stratum without appreciable mining of vertically adjacent strata.

2. In the method of claim 1 said solvent being water or a solution unsaturated in salts.

3. In the method of claim 2 said ore being rich in at least one soluble salt selected from the group consisting of sodium, calcium, magnesium, and potassium salts.

4. In the method of claim 2 said ore being rich in sylvinite.

5. A method of solution mining an extractable ore disposed in a relatively thin sloping subterranean stratum disposed beneath an insoluble stratum comprising the steps of establishing an extraction bore hole communicating with said stratum at a downdip location therein, establishing a plurality of injection bore holes upslope from said extraction bore hole introducing solvent into said injection bore holes in such a manner that the solvent will be directed in an updip direction along the upper portion of said stratum to develop a cavity with a mining face remote from said injection bore holes, and withdrawing solvent with dissolved ore through said extraction bore hole at an exit point disposed vertically from the level of the injection points, adjusting such withdrawal to provide for downflow of the water across said mining face and downwardly in a downdip direction along the floor of said cavity to said exit point at a rate sufficient to extract said ore stratum without appreciable mining of vertically adjacent strata.

6. In the method of claims 1 or 5 said injection into bore holes being adjusted to form an elongated cavity in said ore stratum to provide continued stability in the cavity far above that expected by the previous state of the art.

* * * * *